United States Patent [19]

Riemenschneider, III

[11] Patent Number: 4,535,951

[45] Date of Patent: Aug. 20, 1985

[54] STRETCH FILM WRAPPING DEVICE

[75] Inventor: Paul K. Riemenschneider, III, Grandville, Mich.

[73] Assignee: Highlight Industries, Inc., Grand Rapids, Mich.

[21] Appl. No.: 490,845

[22] Filed: May 2, 1983

[51] Int. Cl.[3] ..... B65H 23/06; B44C 7/00

[52] U.S. Cl. ..... 242/754; 242/96; 242/99

[58] Field of Search ..... 242/96, 99, 68.3, 75.4, 242/156, 156.1, 156.2; 308/231

[56] References Cited

U.S. PATENT DOCUMENTS

| | | | |
|---|---|---|---|
| 556,407 | 3/1896 | Esmond | 242/75.4 |
| 811,136 | 1/1906 | Eveland | 308/231 |
| 2,129,903 | 9/1938 | Benson | 242/84.53 |
| 2,142,582 | 1/1936 | Wright | 242/68.3 |
| 2,483,528 | 10/1949 | Christoff | 242/68.3 |
| 4,102,513 | 7/1978 | Guard | 242/75.4 |

FOREIGN PATENT DOCUMENTS

| | | | |
|---|---|---|---|
| 2065070 | 6/1981 | United Kingdom | 242/96 |

*Primary Examiner*—Stuart S. Levy
*Assistant Examiner*—Lloyd D. Doigan
*Attorney, Agent, or Firm*—John A. Waters

[57] ABSTRACT

A stretch film wrapping device for rotatably supporting a roll of plastic film having a tubular rigid central core includes a pair of opposed core holders interconnected by a length adjustable axle member to effect clamping of the film roll between the core holders. The bottom core holder is mounted on a base member. The top core holder is rotatably mounted on the axle member and is axially shiftable upwardly thereon. A top tension control assembly above the top core holder at the top of the axle member adjusts the clamping force on the film roll and includes a spring which engages the top core holder to resist upward axial shifting of the top core holder when the axle member is adjusted to reduce the distance between the core holders to effect clamping of the film roll between the core holders. The clamping force between the core holders on the film roll varies in direct proportion to the force of the spring in resisting upward axial movement of the top core holder with respect to the axle resulting in precise adjustment of the film tension for the wrapping operation.

18 Claims, 7 Drawing Figures

STRETCH FILM WRAPPING DEVICE

BACKGROUND OF THE INVENTION

1. Field of the Invention:

The present invention relates to a stretch film wrapping device, and, more particularly, to a device for rotatably supporting a roll of plastic film for tension stretch wrapping of objects, containers and the like.

2. Background of the Invention:

In shipping containerized goods, the general practice is to stack a plurality of the containers on a pallet and to utilize material handling equipment such as fork trucks to load and unload the palletized containers. To prevent containers from shifting or from falling off of the palletized load, it is generally required to band or wrap the palletized load. For example, metal or plastic straps or bands in conjunction with clips or buckles have been used for many years for this purpose. In recent years, there has been an increasing use of plastic stretch film to wrap and secure a palletized load of containers. The advantages of the use of plastic stretch film are enumerous. The stretch film produces a tight wrap and provides greater protection to the containers from damage due to harsh weather, abrasion, punctures and the like. The plastic stretch film is of relatively low cost and does not require the use of adhesives, clips or other fasteners.

While there are thus significant advantages to the use of plastic stretch film for wrapping palletized loads of containers, these advantages are not realized unless the wrapping procedure is properly executed. The two most important features of a proper wrap are the uniformity of the wrap and the proper tension of the plastic as it is applied. If the proper tension is not applied to the plastic there will be inadequate stretching of the plastic resulting in a loose wrap with poor holding qualities. In addition, the less the stretch of the plastic, the more the quantity of plastic which will be required, thereby resulting in a higher cost. On the other hand, if the tension on the plastic is too high, the plastic will rip and the advantages of a continuous wrap are lost. Random variations in the plastic tension during application can result in both ripped plastic and a loose wrap. Thus, the goal is to maximize the stretch without risk of tearing, while maintaining a constant predetermined tension during the wrapping procedure.

Although a variety of complex machines have been developed, their high cost, maintenance problems and lack of versatility have rendered them less than satisfactory in most instances. Because of this, a variety of hand held dispensers have been developed. The low cost, simplicity and portability of hand held dispensers would make them the ideal selection in most operations. However, heretofore, none of the hand held dispensers has been entirely satisfactory. To be satisfactory, a hand held dispenser must be durable, low cost and easy to use. Rolls of film must be easily and quickly replaceable. Most important, however, is that the tension adjustment for optimizing plastic stretch must be precise and consistent and produce uniform predetermined tension across the full width of the film for a uniform wrap. While various tension control devices have been developed, none has proven to be satisfactory. Tapered core plugs and other internal core friction devices such as expandable rubber gripping devices have proven to rely too much on the "feel" of the operator resulting in significant variations in the friction settings from operator to operator or from day to day with the same operator. In addition, precise and repeatable predetermined tension settings are not possible with these devices.

Other devices have utilized a pair of opposing core holders and adjusting the clamping force between the core holders on the plastic roll core ends to vary the tension. One such device utilizes a pair of rotatable core holders with the distance between the core holders being adjusted by means of a threaded rod and corresponding internally threaded tube interconnecting the core holders. Although once properly set, this type of device yields relatively uniform tension on the plastic, precise and consistently reproducable predetermined tension settings have not been possible.

Thus, there remains a current need for a hand held stretch film wrapping device which permits precise tension adjustments and consistent reproducable predetermined tension settings.

SUMMARY OF THE INVENTION

According to the present invention there is provided an improved hand held stretch film wrapping device for rotatably supporting a roll of plastic film having a tubular rigid central core. The wrapping device is durable, easy to use and permits quick and simple roll replacement. A unique built-in tension control system optimizes the plastic stretch with precision tension adjustability and permits consistent reproduceable predetermined tension settings. The optimized and consistent plastic stretch yields tighter more secure palletized loads, prevents plastic tearing and minimizes the amount of plastic used with the consequential cost savings.

The wrapping device comprises a base member with a bottom core holder for rotatable engagement by one end of a film roll core. A rotatable top core holder opposes the bottom core holder for engagement by the other end of the film roll core. A length adjustable axle member interconnects the core holders to effect clamping of the film roll between the core holders, with the top core holder being rotatably mounted on the axle member and axially shiftable upwardly on the axle member. In the preferred embodiment, the axle member includes a lower section and an upper section threadably engaged with each other whereby the length adjustment of the axle is achieved by varying the degree of threaded engagement of the axle sections. It is especially preferred that the lower axle section be rigidly affixed to the base member and be internally threaded at its upper end and that the upper axle section have external threads at its lower end to threadably engage the lower axle section.

A top tension control assembly is provided above the top core holder at the top end of the axle member for adjusting the clamping force on the film roll. The tension control assembly includes spring biasing means engaging the top core holder to resist upward axial shifting of the top core holder when the axle member is adjusted to reduce the distance between the core holders to effect clamping of the film roll between the core holders. In the preferred embodiment, the top tension control assembly includes an adjustment knob at the top of the upper axle section which is rigidly affixed thereto, and the spring biasing means is interposed between the knob and the top core holder and is rotatable with respect to the upper axle section. When the knob is rotated to vary the length of the axle by changing the degree of threaded engagement of the axle sections, the clamping force between the core holders on the film roll will vary in direct proportion to the force of the spring biasing means and resist upward axial movement of the top core holder with respect to the upper axle section. The preferred spring biasing means is a disc spring washer, and it is especially preferred to provide a needle bearing washer rotatably interposed between the knob and the disc spring washer.

Also in the preferred embodiment, a resilient pad is interposed between the bottom core holder and the base member, and a handle grip is rigidly affixed to the base member.

DESCRIPTION OF THE PREFERRED EMBODIMENTS

Figure 1:
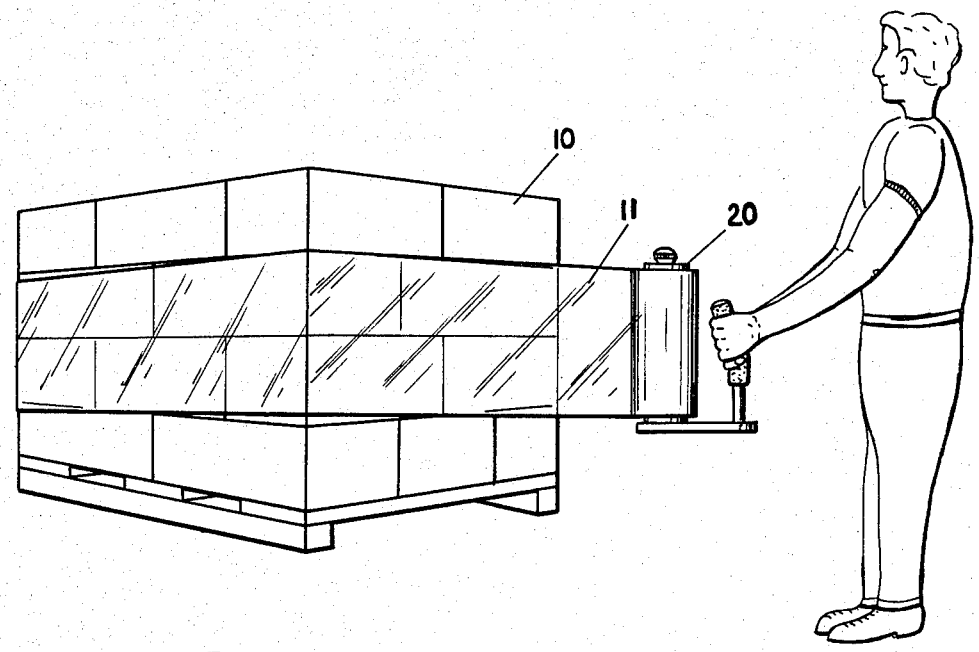
FIG. 1 is a perspective view of an operator using the stretch film wrapping device of the present invention to stretch wrap a pallet load of containers.
Figure 2:
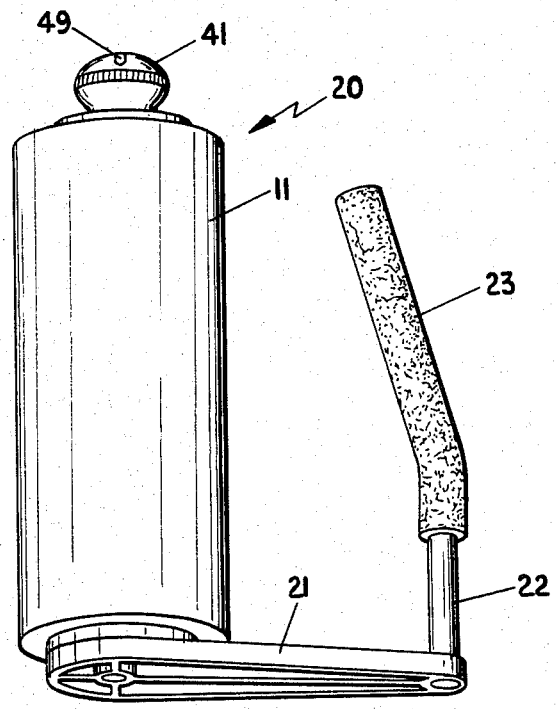
FIG. 2 is a bottom, perspective view of the stretched film wrapping device.
Figure 3:
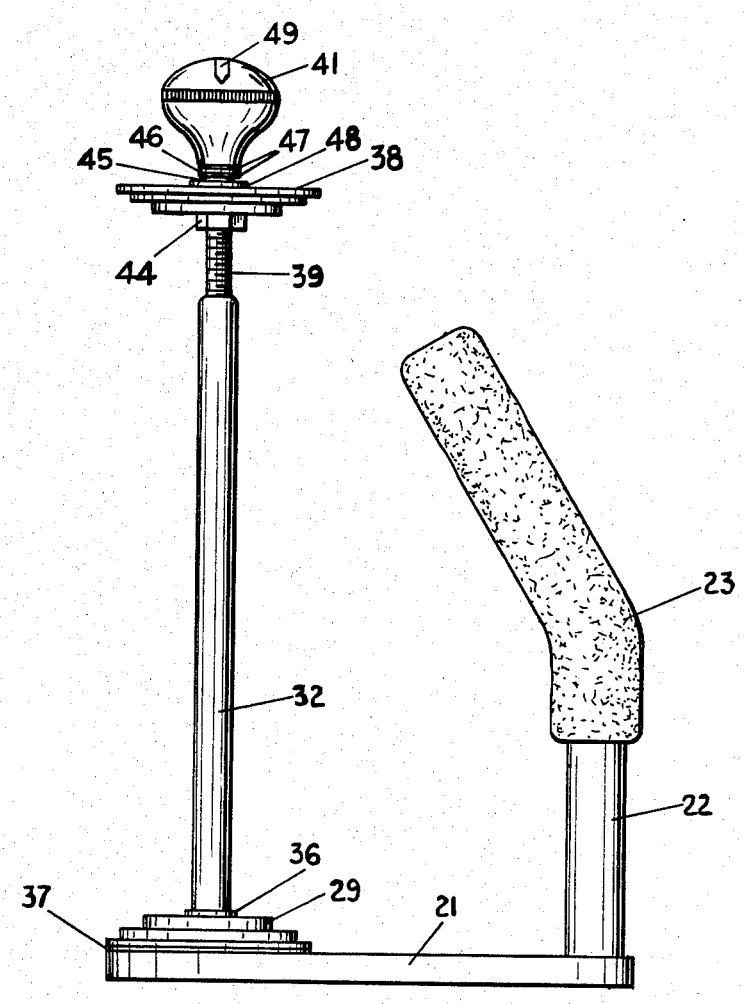
FIG. 3 is a side elevational view of the wrapping device with the roll of plastic film removed.
Figure 6:
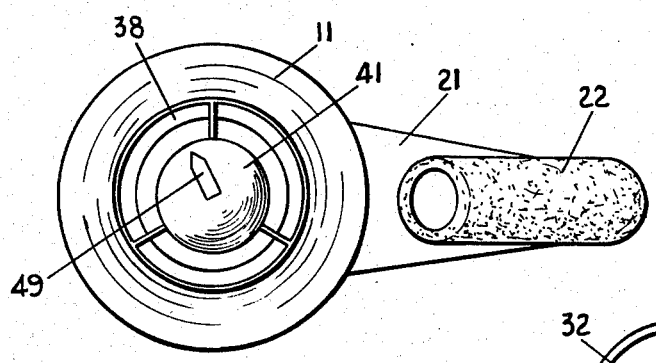
FIG. 6 is a plan view of the wrapping device.
Figure 7:
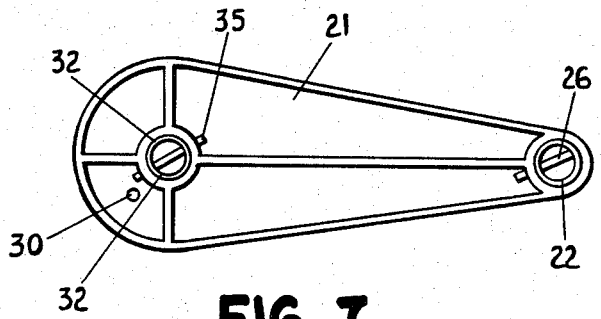
FIG. 7 is a bottom view of the wrapping device.
Figure 4:
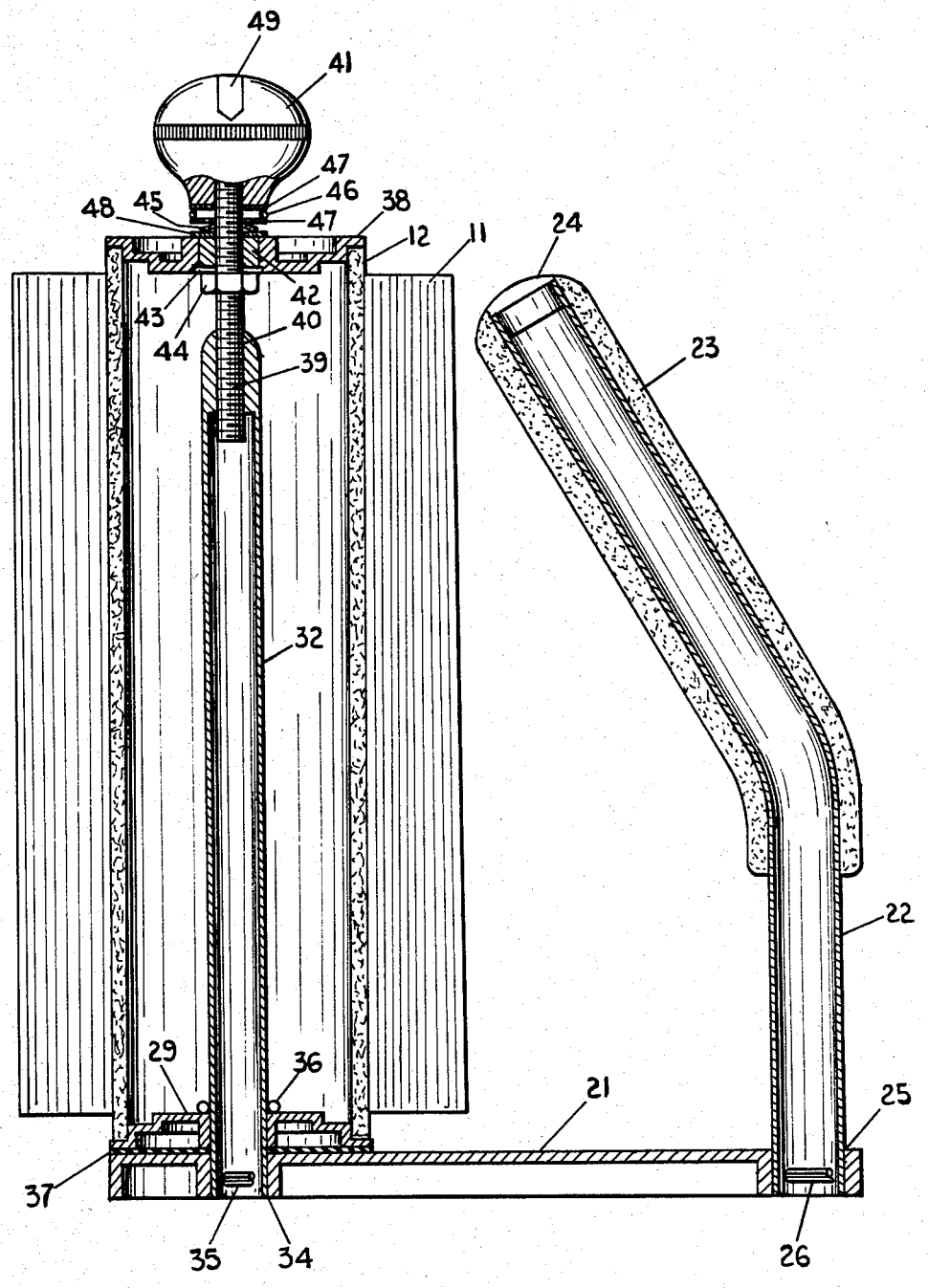
FIG. 4 is a side, cross-sectional view of the wrapping device.
Figure 5:
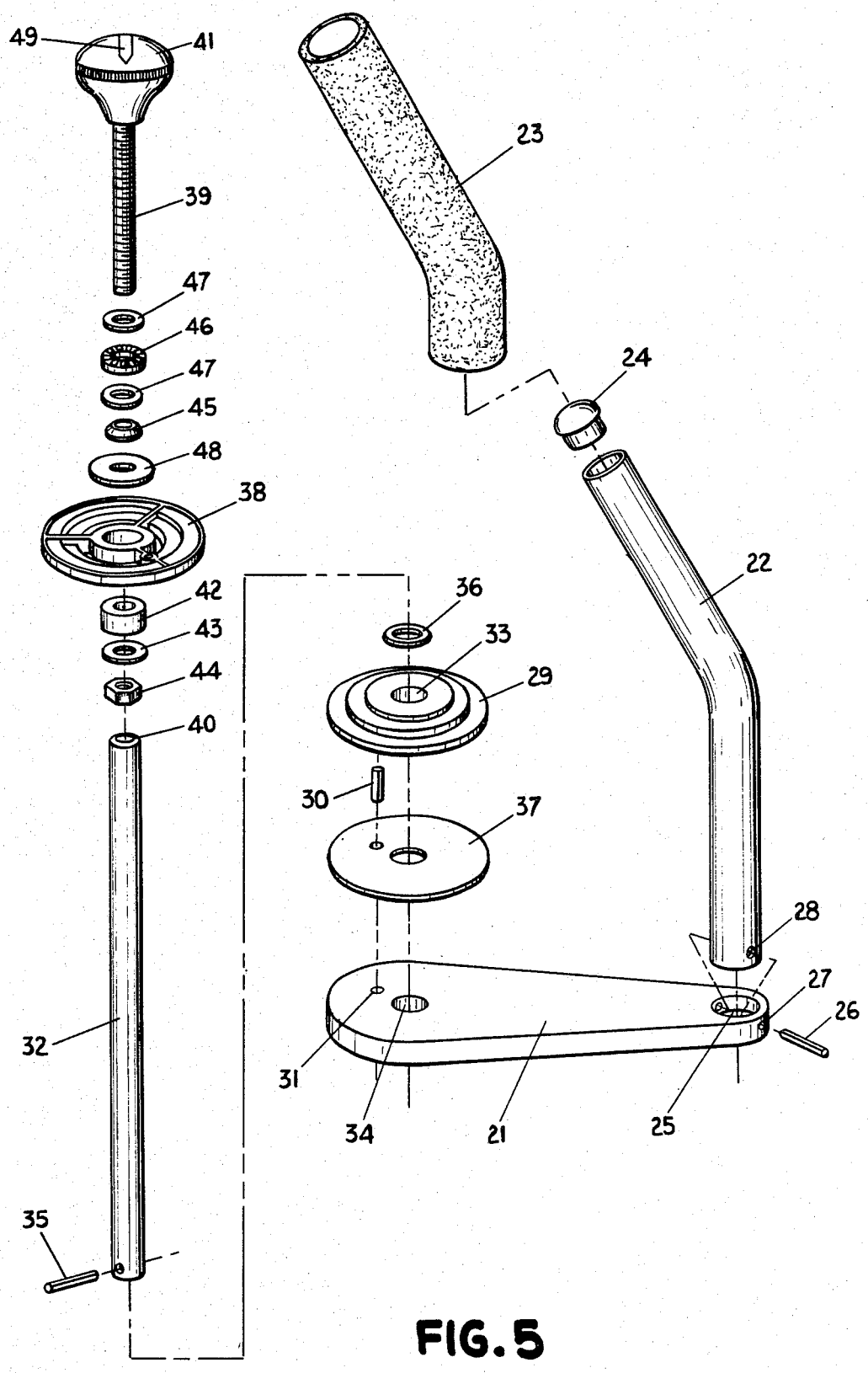
FIG. 5 is an exploded perspective view of the wrapping device.

Referring to the drawings in greater detail, FIG. 1 illustrates the use of the stretched film wrapping device 20 to stretch wrap a pallet load of containers 10 with plastic stretch wrap 11. The details of wrapping device 20 are shown in FIGS. 2 through 7. In FIGS. 3 and 5, the roll of plastic stretch film has been removed to more clearly illustrate the interior structure of wrapping device 20.

Wrapping device 20 includes base plate 21. While base plate 21 can be of a variety of configurations and materials, the configuration shown (FIGS. 5 and 7) provides stability when the device is set down by resisting tip-over which can nick and tear the plastic film. In addition, a die cast zink web design is preferred for superior strength, accuracy and flatness, while minimizing the overall weight of the device. Handle grip 22 is rigidly affixed to the narrow end of base plate 21. The upper portion of handle grip 22 is covered with a cushion foam wrap 23 for comfort and to prevent slipping from the operator's hand. The upper portion of handle 22 is also angled inwardly to make it easier to wrap the lower rows of containers on a pallet, while also locating the grip nearer the center of gravity for less worker fatigue. To minimize weight, handle 22 is preferably made of metal tubing with a protective end cap 24 inserted in the upper end. Handle 22 can be rigidly attached to base plate 21 by insertion into an aperture 25 and locked in place by means of a pin 26 passed through apertures 27 in base plate 21 and corresponding apertures 28 in the lower end of handle 22. For increased structural stability, it is preferred that the lower end of handle 22 be press fit into aperture 25 as well as being pinned in place.

At the enlarged end of base plate 21, a bottom core holder 29 is mounted, preferably non-rotatably. As shown, bottom core holder 29 is a cylindrical member with two stepped down diameters. This is to permit accomodating plastic film rolls of different core diameters. In addition, while bottom core holder 29 can be permanently attached to base plate 21, it is preferred that it be removable for repair or replacement or for interchangeability with bottom core holders sized to accomodate roll cores of differing diameters. When bottom core holder 29 is removable, an anti-rotation pin 30 is press fit into the bottom of holder 29 and inserted through aperture 31 in base plate 21 when bottom core holder 29 is installed. With the bottom end of lower axle section 32 passing through central aperture 33 in bottom core holder 29 and being press fit in base plate aperture 34 and locked in place by pin 35, bottom core holder 29 remains securely in an aligned position during the wrapping operation. A snug fitting O-ring 36 may be provided around axle section 32 on top of bottom core holder 29 to keep bottom holder 29 seated on base plate 20 when changing plastic rolls or when no plastic roll is installed.

Preferably, a resilient pad 37, e.g., rubber or the like, is interposed between bottom core holder 29 and base plate 21. The purpose of pad 37 is to provide a degree of automatic vertical alignment to compensate for uneven plastic roll core ends to prevent skewing of the plastic roll when installed. Since the bottom end of the plastic roll core rotates on the surface of bottom core holder 29 during the wrapping operation, it is important that the bearing surfaces of bottom core holder 29 be even and smooth. To optimize the smoothness of the roll rotation, it is preferred that the bearing surfaces of bottom core holder 29 be coated with a slippery but dry and durable coating such as Teflon.

Opposing bottom core holder 29 is top core holder 38 which has corresponding step down diameter bearing surfaces to engage the top end of the plastic roll core. Core holders 29 and 38 are interconnected by a length adjustable axle member which includes lower axle section 32 and upper axle section 39. Upper axle section 39 is a threaded rod which threadably engages internal threads 40 of tubular lower axle section 32. Adjusting the length of the axle member by increasing or decreasing the threadable engagement of upper axle section 39 with lower axle section 32 will produce a corresponding increase or decrease in the distance between upper core holder 38 and bottom core holder 29 to thereby vary the clamping force on the film roll core ends.

An important aspect of the present invention is the unique precision tension control assembly incorporated in the upper portion of the device. Adjustment knob 41 is rigidly affixed to the top of upper axle section 39. Adjustment knob 41 is rotated to increase or decrease the threaded engagement of upper axle section 39 into lower axle section 40 to increase or decrease the clamping force of the core holders. Since upper core holder 38 is designed to rotate with the film roll as it rotates during the wrapping operation, upper core holder 38 is mounted rotatably with respect to upper axle section 39. To enhance the smoothness of the rotation of upper core holder 38, a bronze bearing 42 is installed in the central aperture of upper core holder 38 which is rotatable about upper axle section 39 and within the central aperture of upper core holder 38. Although not required for proper operation of the device during the wrapping procedure, to facilitate roll changing without loose parts, washer 43 and lock nut 44 are installed on upper axle section 39 below upper core holder 38 to provide a unitized construction.

The precision tension adjustment results from upper core holder 38 being axially shiftable upwardly on upper axle section 39 toward the base of adjustment knob 41. A spring biasing means 45 is interposed between the lower end of adjustment knob 41 and the top of core holder 38 which resists the upward axial movement of core holder 38. To optimize the precision of the tension adjustment and the consistent reproducability of predetermined tension settings, spring biasing means 45 should have a spring load curve which will provide a consistent gradual increase in pressure as the spring means is compressed. The preferred spring means has been found to be a disc or belleville spring washer. The load curves of disc spring washers are determined by the ratio of the overall spring height to the spring thickness. Optimum height to thickness ratios have been found to be between about 0.4 and 1.0. Height to thickness ratios substantially below or above this range do not exhibit consistent gradual increases in pressure applied throughout the deflection of the washer. An especially preferred height to thickness ratio is about 0.7.

In order to optimize the smoothness of the rotation of upper core holder 38 and to prevent wear and galling, it is preferred to interpose a needle bearing sandwiched between a pair of thrust washers between the top of disc spring washer 45 and the bottom surface of adjustment knob 41. Similarly, washer 48 is interposed between the bottom of disc spring washer 45 and the top of upper core holder 38.

To load a roll of plastic film in the wrapping device of the present invention, adjustment knob 41 is rotated counter-clockwise until upper axle section 39 is disengaged from lower axle section 32. With the upper subassembly removed, a roll of plastic film having a tubular rigid central core is placed over lower axle section 32 until the lower end of the core is seated on bottom core holder 29. The upper sub-assembly is then replaced by rotating adjustment knob 41 in a clockwise direction. The rotation of adjustment knob 41 is continued until upper core holder 38 engages the upper end of the film roll core. Since there will be no upward force exerted on top core holder 38 up to this point, disc spring washer 45 remains in a relaxed condition. Once top core holder 38 engages the top end of the film core, a substanial resistance will be felt by the operator in continuing to rotate adjustment knob 41 in a clockwise direction. At the point of this substantial increase in resistance to rotation of adjustment knob 41, the radial position of indicator arrow 49 should be noted. Upon further rotation of adjustment knob 41 in a clockwise direction, the resistance of the engagement of top core holder 38 with the top end of the film roll core will urge top core holder 38 toward adjustment knob 41 with the axial shift being resisted only by the spring force of disc spring washer 45. Thus, at this point until disc spring washer 45 is completely deflected, the increase in clamping force between the core holders is completely a function of the spring force of disc spring washer 45 instead of the degree of threading advance of upper axle section 39 into lower axle section 32. Since disc spring washer 45 provides a consistent gradual increase in applied pressure throughout its deflection, a direct corresponding consistent gradual increase in the clamping force between the core holders is achieved.

For a given kind and thickness of plastic stretch film a trial is conducted to determine the requisite clamping force to yield the optimum film stretch during the wrapping operation. At this desired level of clamping force, the new radial location of indicator 49 with respect to its initial location at the start of the deflection of disc spring washer 45 is noted, e.g., ¼ turn, ½ turn, full turn, etc. Once this initial determination of the optimum clamping force has been determined, as new rolls of the same kind and thickness of plastic stretch film are installed, once the initial resistance is felt, adjustment knob 41 is simply and quickly rotated until indicator 49 traverses the predetermined radial arc, at which point the predetermined optimum clamping force will automatically be reproduced. Once the clamping force is thus set, it will remain constant throughout use of the entire roll of stretch film. During use, unwanted changes of the clamping force cannot occur through loosening of axle section 39 with respect to its threaded engagement with axle section 32 because of vibrations or the like since the force of disc spring washer 45 produces a friction thread locking effect.

The wrapping device of the present invention is suitable for use with virtually any kind of plastic stretch film which is rolled on a tubular rigid central core. For example, stretchable films such as nylon, polypropylene, polyvinylchloride, polybutylene, polyethylene, copolomers or blends thereof and the like may be used. In addition, various alternatives such as plastic netting can also be used. Thus, as used herein, "film" is meant to include variations such as "netting". In the embodiments illustrated in FIG. 4, the roll of plastic film has a tubular rigid cardboard central core 12. However, any tubular rigid central core can be used satisfactorily as long as the core diameter corresponds with the core holder diameters for proper allignment and engagement therewith.

While the preferred embodiments of the present invention have been described and illustrated, it will be obvious to those skilled in the art that various changes and modifications can be made without departing from the spirit of the present invention. Accordingly, the scope of the present invention is deemed to be limited only by the appended claims.

The embodiments of the invention in which an exclusive property or privilege is claimed are defined as follows:

1. A stretch film wrapping device for rotatably supporting a roll of plastic film having a tubular rigid central core comprising:

a base member;

a bottom core holder on said base member for rotatable engagement by one end of said film roll core;

a top core holder opposing said bottom core holder for engagement by the other end of said film roll core;

a length adjustable axle member interconnecting said core holders to effect clamping of said film roll between said core holders; said top core holder being rotatably mounted on said axle member and axially shiftable upwardly on said axle member; and a top tension control assembly above said top core holder at the top end of said axle member for adjusting the clamping force on said film roll including compression spring biasing means engaging said top core holder to resist upward axial shifting of said top core holder when said axle member is adjusted to reduce the distance between said core holders to effect clamping of said film roll between said core holders to permit gradual changes in the clamping force between said core and core holders such that film roll rotation resistance and thus film tension can be predictably adjusted through a wide tension range.

2. A stretch film wrapping device according to claim 1 wherein said axle member includes a lower section and an upper section threadably engaged with each other whereby length adjustment of said axle is achieved by varying the degree of threaded engagement of said axle sections.

3. A stretch film wrapping device according to claim 2 wherein said top tension control assembly comprises an adjustment knob at the top of said upper axle section and rigidly affixed thereto and wherein said spring biasing means is interposed between said knob and said top core holder and is rotatable with respect to said upper axle section whereby when said knob is rotated to vary the length of said axle by changing the degree of threaded engagement of said axle sections, the clamping force between said core holders on said film roll will vary in direct proportion to the force of said spring biasing means in resisting upward axial movement of said top core holder with respect to said upper axle section.

4. A stretch film wrapping device according to claim 3 wherein said spring biasing means is a disc spring washer.

5. A stretch film wrapping device according to claim 4 further comprising a needle bearing washer rotatably interposed between said knob and said disc spring washer.

6. A stretch film wrapping device according to claim 4 further comprising a resilient pad interposed between said bottom core holder and said base member.

7. A stretch film wrapping device according to claim 4 further comprising a handle grip rigidly affixed to said base member.

8. A stretch film wrapping device according to claim 4 wherein said lower axle section is rigidly affixed to said base member and is internally threaded at its upper end and said upper axle section has external threads at its lower end.

9. A stretch film wrapping device according to claim 3 further comprising indicator means on said adjustment knob to indicate the degree of rotation of said adjustment knob.

10. A stretch film wrapping device for rotatably supporting a roll of plastic film having a tubular rigid central core comprising:

a base member and a top member mounted at opposite ends of the central core, at least one of said members providing resistance to rotational movement of the film roll as film is pulled from the wrapping device, with the rotational resistance and a consequent increase in film tension and stretching increasing as the pressure between the member and the central core increases;

an axle interconnecting the two members through a spring connection that urges the members together with a spring force that varies in relation to the amount of distortion of the spring, the spring connection being of a type that permits gradual adjustment of the pressure between the members such that film roll rotation resistance and thus film tension on the roll can be predictably adjusted through a wide tension range short of breaking the film by gradual distortion of the spring connection; and adjustment means for gradually varying the distortion of the spring connection so as to gradually vary the pressure between the members and the central core, whereby the extent to which the film is stretched while wrapping a package can be maximized and film usage can be minimized.

11. A stretch film wrapping device according to claim 10 wherein the spring connection comprises at least one disc spring, interconnecting the axle with at least one member, the adjustment means comprising a threaded adjustment mechanism means on the axle for adjusting the distortion of the spring between the axle and the one member.

12. A stretch film wrapping device according to claim 10 wherein the axle extends through one member to a head positioned on the outer side of said member, said member being axially slidable on the axle, the axle including threaded adjustment means for varying the distance between the head and the other member, the spring comprising at least one disc spring interposed between the head and said one member.

13. A stretch film wrapping device according to claim 12 wherein the head is threadably connected to the axle such that the head can be rotated to vary the pressure on the disc spring and the tension on the film, the disc spring being constructed such that film stretch can be maximized without breaking the film.

14. A stretch film wrapping device according to claim 13 wherein the disc spring has a height to thickness ratio of about 0.4 to 1.0.

15. A stretch film wrapping device according to claim 14 wherein the disc spring has a height to thickness ratio of about 0.7.

16. A stretch film wrapping device for rotatably supporting a roll of plastic film having a tubular rigid central core comprising:

a base member positioned at one end of the core;

a top member positioned at the other end of the core, at least one of the members being non-rotatable;

an axle interconnecting the base member and top member, the axle extending from the base member, through the central core of the film roll, and through the top member;

a head mounted on the axle on the outer side of the top member, the head being movable with respect to the base member in an axial direction with respect to the axis of the axle;

disc spring means comprising at least one disc spring positioned between the head and the top member, the disc spring resisting axial compression between the head and top member with a force that increases in generally linear proportion to the amount of compression of the spring, movement of the head inwardly toward the base member compressing the disc spring against the top member with the compressive force of the disc spring and causing the rigid central core to be compressed between the top member and base member with such force, the non-rotatable member providing resistance to rotation of the rigid central core with respect to said member in proportion to the pressure between said member and the rigid central core, whereby the rotation resistance exerted on the plastic film roll and the consequent stretch of the film can be adjusted in a generally linear fashion by axial movement of the head so as to vary the pressure on the disc spring.

17. A stretch film wrapping device according to claim 16 wherein the disc spring means is adjustable through a gradual range of tension adjustment to permit a gradual increase in the amount of film stretch until maximum film stretch is achieved.

18. A stretch film wrapping device according to claim 17 wherein there is a threaded connector in the axle between the head and the base such that radial rotation of the head with respect to the base causes axial movement of the head with respect to the base, the disc spring means being such that the radial position of the head with respect to the base is indicative of the amount of stretch imparted to the plastic film.

* * * * *